US006781142B2

(12) United States Patent
Hutcheson

(10) Patent No.: US 6,781,142 B2
(45) Date of Patent: Aug. 24, 2004

(54) RADIATION-SHIELDING CONTAINER

(75) Inventor: William S. Hutcheson, West Allis, WI (US)

(73) Assignee: Vulcan Lead, Inc., Milwaukee, WI (US)

( * ) Notice: Subject to any disclaimer, the term of this patent is extended or adjusted under 35 U.S.C. 154(b) by 0 days.

(21) Appl. No.: 10/301,205

(22) Filed: Nov. 21, 2002

(65) Prior Publication Data

US 2004/0135105 A1 Jul. 15, 2004

Related U.S. Application Data

(60) Provisional application No. 60/332,613, filed on Nov. 23, 2001.

(51) Int. Cl.[7] ..... B65D 90/04

(52) U.S. Cl. ..... 250/506.1; 250/507.1; 220/468; 220/270

(58) Field of Search ..... 250/506.1, 505.1, 250/507.1; 220/468, 270, 408, 266, 268; 215/1 R, 256; 206/524.2

(56) References Cited

U.S. PATENT DOCUMENTS 4,923,088 A * 5/1990 Tanaka et al. ..... 220/23.87
5,834,788 A * 11/1998 Fu et al. ..... 250/506.1
5,927,351 A * 7/1999 Zhu et al. ..... 141/330

* cited by examiner

*Primary Examiner*—John R. Lee
*Assistant Examiner*—Zia R. Hashmi
(74) *Attorney, Agent, or Firm*—Michael Best & Friedrich LLP

(57) ABSTRACT

A radiation-shielding container has an elongated cylindrical base and a cylindrical cap that define a cavity. A reduced portion of the cap extends into the base and includes a planar end surface that engages an internal shoulder within the base, and an external shoulder that engages an annular end surface of the base. The cap is secured to the base by rotating the cap such that tabs defined on the reduced portion slide along inwardly sloping lower engagement surfaces of the base until the tabs abut stop surfaces of the base and are secured by upper engagement surfaces. Removal of the cap is accomplished by rotating the cap in the opposite direction to disengage the tabs from the upper engagement surfaces.

30 Claims, 2 Drawing Sheets

RADIATION-SHIELDING CONTAINER

This application claims the benefit of prior filed co-pending provisional patent application No. 60/332,613 filed on Nov. 23, 2001.

FIELD OF THE INVENTION

The invention relates to radiation-shielding containers, and more particularly to containers for radioactive pharmaceuticals.

BACKGROUND OF THE INVENTION

Radiation-shielding containers or "pigs" are well known in the medical industry for transporting and storing radioactive substances, particularly radioactive drugs known as radiopharmaceuticals. Many prior art containers utilize a hollow, jar-like body with a lid. In order for these containers to effectively shield the radiation emitted by the radiopharmaceutical in the container there must be a tight seal between the radiation-shielding material of the body and the lid.

Prior art containers have provided tightly sealed components in a variety of ways. Some containers utilize a construction having a two-piece container with smooth mating surfaces that can be clamped together, thereby forming a seal. Each piece is typically made from a high-density radiation-shielding material such as lead or tungsten.

Other prior art containers have attempted to provide a means for securing the lid directly to the body using well-known methods such as engageable threads or snap fits. This configuration offers the advantage of simplicity and overcomes the requirement of additional structure to seal the container.

SUMMARY OF THE INVENTION

Radiation shielding materials, particularly lead, are generally extremely ductile and offer limited durability when machined or formed to provide threaded engagement. Known container assemblies relying on clamping apparatus entail the disadvantageous aspect of requiring additional structure to secure multiple container components together, such as a removable plastic housing or a series of clamps. This additional structure adds undesirable complication and cost to the container and can be difficult to assemble and disassemble. As such, a radiation-shielding container that is inexpensive, durable, easy to use, and that may be fabricated entirely of high-density radiation-shielding material, would be welcomed by those in the industry.

Accordingly, in one embodiment the present invention provides a radiation-shielding container for a radiopharmaceutical. The container includes a generally cylindrical base that is formed of a radiation-shielding material and includes an inner surface defining a cavity and a central axis. The cavity includes an open end and a closed end, and the base defines at least one helically extending groove that is radially outwardly recessed with respect to the inner surface and extends generally inwardly from the open end. The container also includes a generally cylindrical cap that is formed of a radiation-shielding material and includes a generally annular protrusion that is received by the cavity. The cap also includes at least one tab that extends radially outwardly from the annular protrusion and is engageable with the at least one recess to secure the cap to the base, thereby closing the cavity.

In another embodiment, the present invention also provides a container for radioactive substances that includes a base having an interior wall defining an open end, a cavity, a central axis, and a recess extending axially inwardly from the open end. The recess includes a lower engagement surface that faces the open end and extends between a first edge that is adjacent the open end to a second edge that is circumferentially and axially inwardly spaced from the first edge. The recess also includes a stop surface adjacent the second edge, and an upper engagement surface facing the lower engagement surface and extending from the stop surface toward the open end. The container also includes a cap having a cross-sectionally reduced portion that is receivable by the open end of the base to extend into the cavity. The reduced portion includes a radially outwardly extending tab that is receivable by the recess and is engageable with the lower engagement surface. The container is configured such that rotation of the cap with respect to the base about the axis slides the tab along the lower engagement surface and into abutment with the stop surface and the upper engagement surface, thereby securing the cap to the base.

Other features of the invention will become apparent to those skilled in the art upon review of the following detailed description, claims, and drawings.

Figure 1:
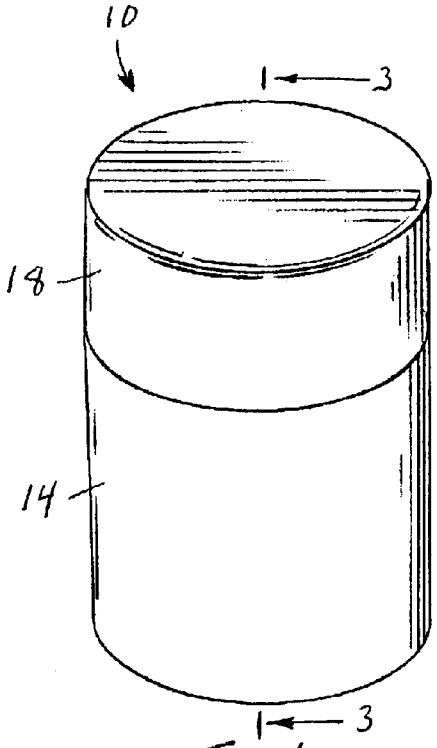
FIG. 1 is a perspective view of a radiation-shielding container of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

The drawings illustrate a radiation-shielding container assembly 10 embodying the invention. As shown in FIG. 1, the container assembly 10 includes a generally cylindrical base 14 and a generally cylindrical cap 18 which can be selectively secured to the base 14. The base 14 and cap 18 are preferably made of a radiation-shielding material such as a high-density metal, e.g., lead or tungsten, or other materials (including lower density materials) that are also effective to block radiation. The cap 18 is configured to be easily removed from and secured to the base 14.

Figure 2:
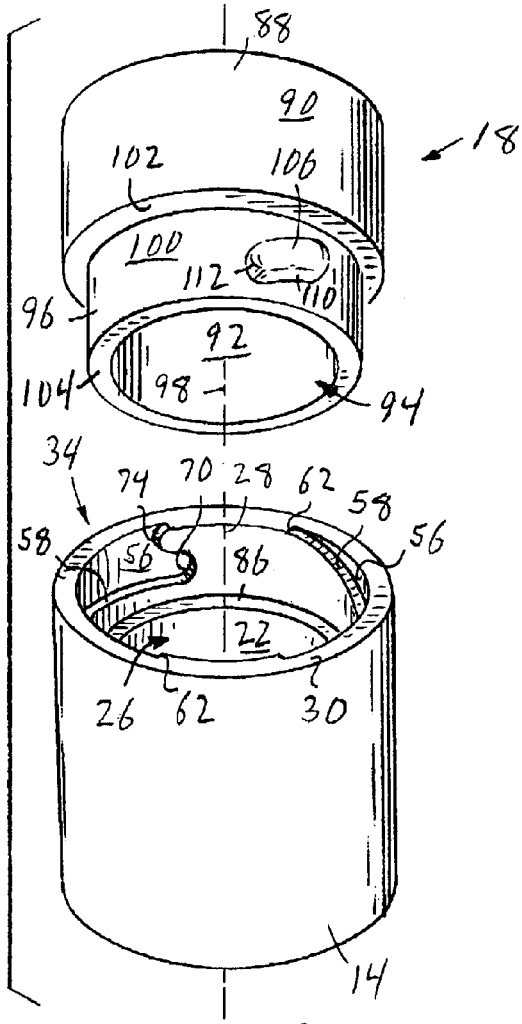
FIG. 2 is an exploded view of the radiation-shielding container illustrated in FIG. 1.

Referring to FIG. 2, the base 14 includes an interior wall 22 defining a cavity 26 and a central longitudinal axis 28. The base 14 has an open end which is defined by an annular wall 30 and which provides an opening 34 communicating with the cavity 26.

Referring to FIGS. 3–6, the interior wall 22 of the base 14 provides a pair of recesses 56 extending generally helically from the annular wall 30 and into the cavity 26. The recesses 56 are substantially identical, as such, only one recess 56 is described further below.

Each recess 56 provides a lower engagement surface 58 (see FIGS. 2 and 6) which generally faces axially toward the opening 34. The lower engagement surface 58 extends between a first edge 62 adjacent the annular wall 30 to a second edge 66 which is circumferentially and axially inwardly spaced from the first edge 62.

The recess 56 also includes (FIG. 6) an arcuate stop surface 70 that extends from the second edge 66 toward the opening 34. The stop surface 70 is concave and generally continuous with the lower engagement surface 58. The recess 56 also includes an upper engagement surface 74 which faces the lower engagement surface 58 and extends generally continuously from the stop surface 70 to the annual wall 30 along a path that initially opposes the lower engagement surface 58 and then forms (FIGS. 2 and 6) a convex surface joining with the annular wall 30. The stop surface 70 and the upper engagement surface 74 cooperate to define a generally continuous S-shaped surface extending from the lower engagement surface 58 to the annular wall 30.

The base 14 also includes a shoulder 86 which extends radially into the cavity 34 at a location axially inwardly spaced from the lower engagement surface 58. The shoulder 86 faces the opening 34 and engages the cap 18 to seal the container, in a manner discussed further below.

Referring to FIG. 2, the cap 18 has a first, cap portion 88 that includes a generally cylindrical outer surface 90 and an internal surface 92 defining a cavity 94. The outer surface 90 of the cap portion 88 has a circumference and configuration similar to the base 14. The cap 18 also includes a reduced cylindrical portion 96 having a generally annular cross section and extending axially away from the cap portion 88 along a cap axis 98. The reduced portion 96 includes an outer surface 100 having a reduced diameter with respect to the outer surface 90 of the cap portion. An external shoulder 102 is therefore defined between the outer surface 90 of the cap portion 88 and the outer surface 100 of the reduced portion 96. The reduced portion 96 also provides an annular end wall 104 that is spaced a distance from the external shoulder 102. The reduced portion 96 is configured to be received by the opening 34 of the base 14 and to extend into the cavity 26.

Figure 6:
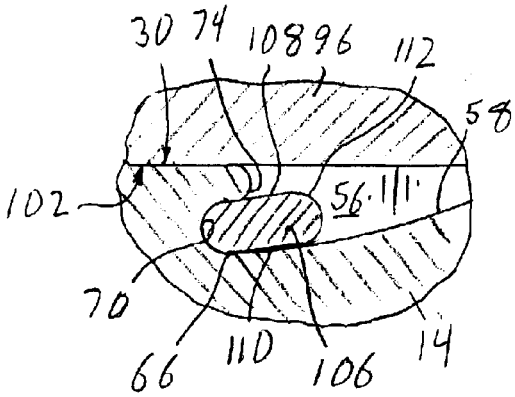
FIG. 6 is a cross-sectional view taken along line 6—6 in FIG. 5.
Figure 3:
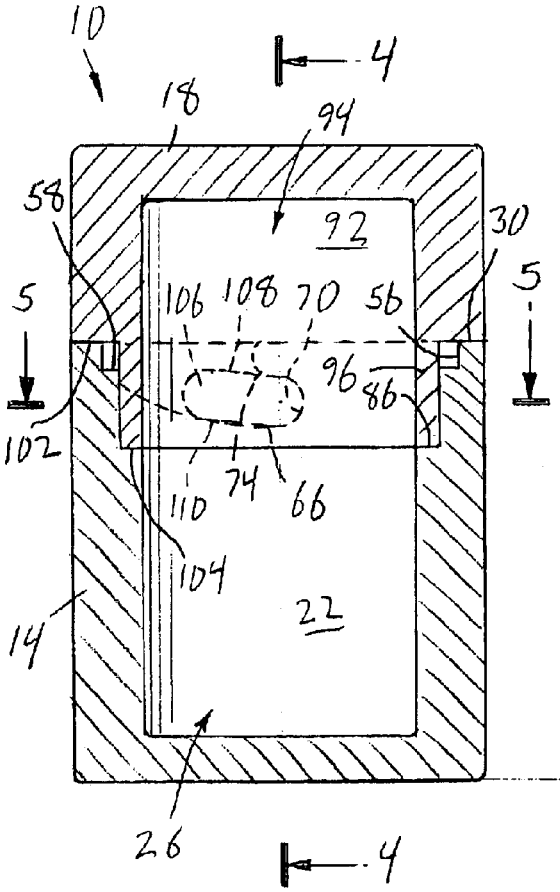
FIG. 3 is a cross-sectional view taken along line 3—3 in FIG. 1.
Figure 4:
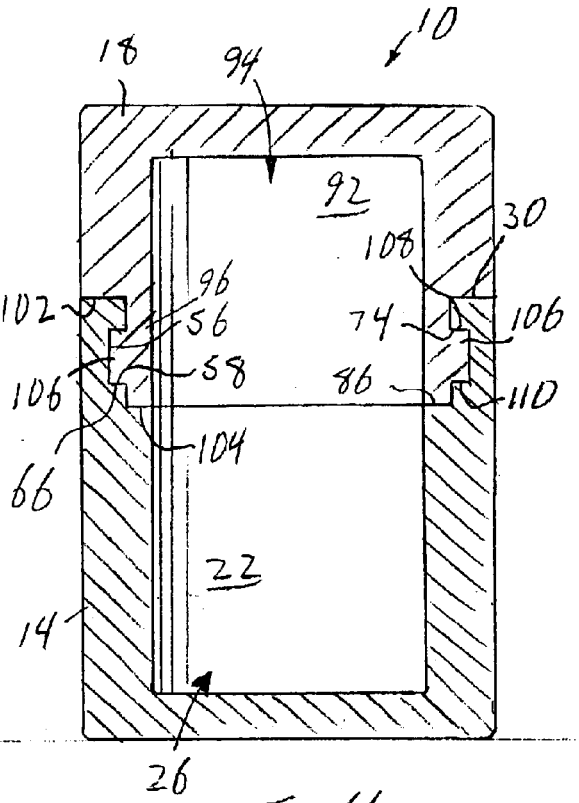
FIG. 4 is a cross-sectional view taken along line 4—4 in FIG. 3.
Figure 5:
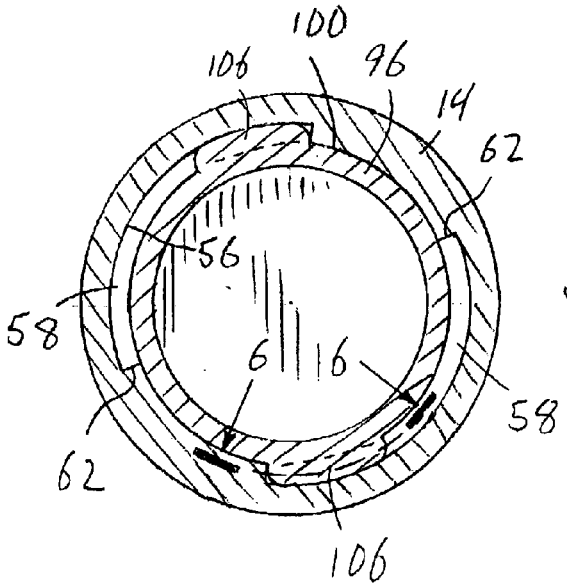
FIG. 5 is a cross-sectional view taken along line 5—5 in FIG. 3.

Referring also to FIGS. 4 and 5, the reduced portion 96 includes a pair of tabs 106 extending radially outwardly from the outer surface 100 (only one tab 106 is shown in FIG. 2). The tabs 106 are substantially identical, as such, only one tab 106 is described in further detail below. As best shown in FIGS. 2 and 6, the tab 106 includes an upper face 108, a lower face 110, and a pair of opposed convex end surfaces 112 extending between the upper and lower faces 108, 110. The tab 106 is axially spaced from the annular end wall 104 of the reduced portion 96 by a distance that is equal to the distance between the internal shoulder 86 and the second edge 66 of the base 14. In addition, the width and height of the tab 106 are similar to the width and depth of the recess 56 in the vicinity of the stop surface 70. The configuration of the cap 18 and the base 14 are such that when the cap is secured to the base, the recesses 56 snugly receive the tabs 106 between the upper and lower engagement surfaces 56, 74, the external shoulder 102 of the cap 18 matingly engages the annular wall 30 of the base 14, and the annular end wall 104 of the cap 18 matingly engages the internal shoulder 86 in the base 14. Engagement between the elements described above substantially secures the cap 18 to the base 14 and provides overlapping sections of the cap 18 and base 14 to facilitate radiation shielding. Further in this regard, the upper and lower faces 108 and 110 of the tabs are preferably angled with respect to the cap axis 98 along respective parallel planes. The angle of incline of the faces 108, 110 relative to the cap axis 98 and the axis 28 of the base 14 when the cap 18 is engaged with the base 14 provides an slight interference fit between the tabs 106 and the upper and lower engagement surfaces 74, 58 of the recesses 56. In the illustrated embodiment, the angles of the faces 108, 110 relative to the axis 98 are about 6 degrees from normal, however other angles can also be utilized depending upon a particular application.

The container assembly 10 can be used as follows. When the central axes of base 14 and the cap 18 are brought into alignment, the external shoulder 102 and annular end wall 104 of the cap 18 are substantially parallel to the internal shoulder 86 and the annular wall 30 of the base 14. Insertion of the reduced portion 96 into the opening 34 of the cavity 26 engages the lower faces 110 of the tabs 106 with the lower engagement surfaces 58 adjacent the annular wall 30. Rotation of the cap 18 with respect to the base 14 allows the lower faces 110 of the tabs 106 to slide along the lower engagement surfaces 58 of the recesses 56 such that the cap 18 is guided axially into the cavity 26. As the tabs 106 approach the stop surfaces 70, the upper faces 108 of the tabs 106 engage the upper engagement surfaces 74. Further rotation of the cap 18 with respect to the body 14 substantially simultaneously brings the convex end surfaces 112 of the tabs 106 into engagement with the stop surfaces 70, the external shoulder 102 into engagement with the annular wall 30, and the annular end wall 104 into engagement with the internal shoulder 86, thereby securing the cap 18 to the body 14 and joining the cavities 26, 94 to form a single enclosed radiation-shielding chamber.

Removal of the cap 18 can be accomplished by rotation of the cap 18 with respect to the body 14 in a direction opposite that used to secure the cap 18 to the body 14. Appropriate rotation will disengage the tabs 106 from the engagement surfaces 74, 58 allowing the cap 18 to be removed from the body 14 without damage to either component of the container 10.

The cap 18 and the body 14 are each preferably substantially completely formed by a single casting operation. In this respect, the tabs 106, the recesses 56, the shoulders 102, 86, and the other structural features of the cap 18 and the body 14 are all formed during the casting process, thereby eliminating the need for additional machining or further manufacturing operations.

Various features of the invention are set forth in the following claims.

What is claimed is:

1. A radiation-shielding container for a radiopharmaceutical, the container comprising:

a generally cylindrical base formed of a radiation-shielding material and including an inner surface defining a cavity and a central axis, the cavity including an open end and a closed end and the base defining at least one helically extending recess that is radially outwardly recessed with respect to the inner surface and extends generally inwardly from the open end; and a generally cylindrical cap formed of a radiation-shielding material and including a generally annular protrusion that is receivable by the cavity, the cap also including at least one tab extending radially outwardly from the annular protrusion and engageable with the at least one recess to secure the cap to the base and to thereby close the cavity.

2. The container of claim 1, wherein the base includes a generally annular shoulder axially inwardly spaced from the at least one helically extending recess and facing the open end, and wherein the annular protrusion includes an end surface that is engageable with the shoulder when the cap is secured to the base.

3. The container of claim 1, wherein the base includes two recesses that are substantially diametrically opposed to one another, and wherein the cap includes two tabs that are substantially diametrically opposed to one another.

4. The container of claim 1, wherein the base includes a lower engagement surface facing toward the open end and at least partially defining the at least one helically extending recess, the lower engagement surface extending circumferentially around the cavity and axially inwardly from the open end.

5. The container of claim 4, wherein the base also includes an arcuate stop surface that extends from an axially innermost edge of the lower engagement surface toward the open end.

6. The container of claim 5, wherein the arcuate stop surface is concaved.

7. The container of claim 6, wherein the at least one tab includes a convex end surface that is substantially matingly engageable with the arcuate stop surface when the cap is secured to the base.

8. The container of claim 5, wherein the base also includes an upper engagement surface facing the lower engagement surface and extending from an axially outer-most edge of the arcuate stop surface toward the open end.

9. The container of claim 8, wherein the stop surface and the upper engagement surface cooperate to define a generally S-shaped surface extending from the axially inner-most edge of the lower engagement surface to the open end.

10. The container of claim 8, wherein the tab is receivable between the lower engagement surface and the upper engagement surface to secure the cap to the base.

11. The container of claim 1, wherein the base and the cap are formed of the same high-density material, and wherein the high-density material is at least one of lead and tungsten.

12. The container of claim 1, wherein the base and the cap are each formed by casting, and wherein the at least one recess and the at least one tab are integrally cast with the base and the cap respectively.

13. A container for radioactive substances comprising:

a base including an interior wall defining an open end, a cavity, a central axis, and a recess extending axially inwardly from the open end, the recess including a lower engagement surface facing the open end and extending between a first edge adjacent the open end to a second edge circumferentially and axially inwardly spaced from the first edge, the recess also including a stop surface adjacent the second edge, and an upper engagement surface facing the lower engagement surface and extending from the stop surface toward the open end; and a cap including a cross-sectionally reduced portion receivable by the open end of the base to extend into the cavity, the reduced portion including a radially outwardly extending tab receivable by the recess and engageable with the lower engagement surface, wherein rotation of the cap with respect to the base about the axis slides the tab along the lower engagement surface and into abutment with the stop surface and the upper engagement surface to thereby secure the cap to the base.

14. The container of claim 13 wherein the cap includes a cap portion extending from the reduced portion and defining an annular shoulder facing the tab, the annular shoulder engaging the open end of the base when the cap is secured to the base.

15. The container of claim 14 wherein when the cap is secured to the base, the shoulder and the open end cooperate to define a plane that is substantially normal to the central axis.

16. The container of claim 13 wherein the reduced portion of the cap includes a distal end and the interior wall of the base defines a shoulder extending radially into the cavity and facing axially toward the open end, and wherein the internal shoulder and the distal end engage each other when the cap is secured to the base.

17. The container of claim 16 wherein the distal end and the shoulder lie in a plane that is substantially normal to the central axis when the cap is secured to the base.

18. The container of claim 13 wherein at least one of the cap and body are formed of a high-density material including at least one of lead and tungsten.

19. The container of claim 13 wherein the tab engages the lower engagement surface, the upper engagement surface, and substantially the entire stop surface.

20. The container of claim 13 wherein the tab includes upper and lower faces that are angled with respect to the central axis.

21. A radiation-shielding container for a radiopharmaceutical, the container comprising:

a generally cylindrical base formed of a radiation-shielding material and including an inner surface defining a cavity and a central axis, the cavity including an open end and a closed end and defining a circumference, the base defining at least one helically extending recess that is radially outwardly recessed with respect to the inner surface, extends generally inwardly from the open end and extends only partially around the circumference of the cavity; and a generally cylindrical cap formed of a radiation-shielding material and including a generally annular protrusion that is receivable by the cavity, the cap also including at least one tab extending radially outwardly from the annular protrusion and engageable with the at least one recess to secure the cap to the base and to thereby close the cavity.

22. The container of claim 21, wherein the base includes a generally annular shoulder axially inwardly spaced from the at least one helically extending recess and facing the open end, and wherein the annular protrusion includes an end surface that is engageable with the shoulder when the cap is secured to the base.

23. The container of claim 21, wherein the helically extending recess is a first helically extending recess, the base further defining a second helically extending recess that is radially outwardly recessed with respect to the inner surface and extends generally inwardly from the open end and only partially around the circumference of the cavity, and wherein the tab is a first tab, the cap further including a second tab extending radially outwardly from the annular protrusion and being substantially diametrically opposed to the first tab, and wherein each of the tabs is engageable with one of the recesses to secure the cap to the base and to thereby close the cavity.

24. The container of claim 21, wherein the base includes a lower engagement surface facing toward the open end and at least partially defining the at least one helically extending recess, the lower engagement surface extending partially circumferentially around the cavity and axially inwardly from the open end.

25. The container of claim 24, wherein the base also includes an arcuate stop surface that extends from an axially innermost edge of the lower engagement surface toward the open end.

26. The container of claim 25, wherein the arcuate stop surface is concaved.

27. The container of claim 26, wherein the at least one tab includes a convex end surface that is substantially matingly engageable with the arcuate stop surface when the cap is secured to the base.

28. The container of claim 25, wherein the base also includes an upper engagement surface facing the lower engagement surface and extending from an axially outermost edge of the arcuate step surface toward the open end.

29. The container of claim 28, wherein the stop surface and the upper engagement surface cooperate to define a generally S-shaped surface extending from the axially innermost edge of the lower engagement surface to the open end.

30. The container of claim 28, wherein the tab is receivable between the lower engagement surface and the upper engagement to secure the cap to the base.

* * * * *